United States Patent [19]

Shiga et al.

[11] Patent Number: 4,892,141

[45] Date of Patent: Jan. 9, 1990

[54] FIN OF HEAT EXCHANGER AND METHOD OF MAKING IT

[75] Inventors: Shoji Shiga; Akira Matsuda; Hideo Suda; Nobuyuki Shibata, all of Nikko, Japan

[73] Assignee: The Furukawa Electric Co., Ltd., Tokyo, Japan

[21] Appl. No.: 372,158

[22] Filed: Jun. 27, 1989

Related U.S. Application Data

[63] Continuation of Ser. No. 873,641, Dec. 27, 1988, abandoned.

[51] Int. Cl.[4] ..... F28F 19/02

[52] U.S. Cl. ..... 165/133; 165/134.1; 165/905

[58] Field of Search ..... 165/133, 134.1, 905; 428/941, 610, 674, 675; 29/157.3 R

[56] References Cited

U.S. PATENT DOCUMENTS 3,857,681 12/1974 Yates et al. ..... 428/675 X

FOREIGN PATENT DOCUMENTS 4719816 11/1972 Japan .
1018357 2/1976 Japan ..... 165/133
3093116 8/1978 Japan ..... 165/905
4038219 3/1979 Japan ..... 165/134
56-149292 11/1981 Japan .
57-105694 7/1982 Japan ..... 165/905
5795397 6/1984 Japan .
59-130996 9/1984 Japan .
58144040 2/1985 Japan ..... 165/905
60-121264 6/1985 Japan .
60-122896 7/1985 Japan .
60-194062 10/1985 Japan .
60-194296 10/1985 Japan .
60-238487 11/1985 Japan .
1400392 7/1975 United Kingdom ..... 165/133

OTHER PUBLICATIONS

Patent Abstracts of Japan, vol. 8, No. 207 (M-327) [1644], 21st Sep. 1984; & JP-A-59 95 397 (Nippon Radiator K.K.) 01-06-1984.

Patent Abstracts of Japan, vol. 9, No. 279 (M 427) [2002] 7th Nov. 1985; & JP-A-60 122 896 (Nippon Radiator K.K.) 01-07-1985.

*Primary Examiner*—Ira S. Lazarus
*Assistant Examiner*—R. R. Cole
*Attorney, Agent, or Firm*—Armstrong, Nikaido, Marmelstein, Kubovcik & Murray

[57] ABSTRACT

A fin is provided, wherein a Cu-Zn diffused alloy layer with a Zn content of not less than 1 wt % is formed on at least a portion of the surface of Cu-based substrate for a fin. For the formation of such a Cu-Zn diffused alloy layer, Zn is allowed to diffuse thermally after covered the surface of Cu-based substrate with Zn or Zn alloy, and a rolling processing is carried out after the thermal diffusion to finish to a desired size. The Zn concentration of the fin decreases continuously from the outside surface of the Cu-Zn diffused layer to the interface between that layer and the Cu-based fin substrate.

12 Claims, 1 Drawing Sheet

FIN OF HEAT EXCHANGER AND METHOD OF MAKING IT

This application is a continuation of application Ser. No. 873,641 filed Dec. 27, 1988 now abandoned.

BACKGROUND OF THE INVENTION

The present invention relates to a fin of heat exchanger and a method of making it. In particular, the invention has made the thinning of the fin possible because of an improvement in the corrosion resistance without lowering the heat transferability as a fin. The fin of the invention is suitable particularly for the heat exchangers used under conditions of an intensely corrosive environment, as in the case of cars etc.

For the radiating fin used for the shell and tube type heat exchanger, strength and corrosion resistance are required together with heat transferability. For instance, the heat exchanger for a car uses a radiator for cooling the engine and a heater for air-conditioning. In all cases, a copper core fitted up with the fins between a plurality of tubes through which the heat exchange medium circulates is used and tanks are installed at both ends of said core through washer plates. Namely, in the radiator, as shown in FIG. 1, the core (3) is constructed by fitting up with the corrugated fins (2) between a plurality of up- and downward tubes (1) through which the heat exchange medium circulates, the washer plates (4*a*) and (4*b*) are provided at both ends of tubes (1) in said core (3), and the tanks (5*a*) and (5*b*) are installed onto said washer plates (4*a*) and (4*b*). Besides, in the diagram, numerals (6) and (7) indicate the entrance and exit for refluxing of the heat exchange medium and numerals (8) and (9) indicate the injection and ejection ports of the heat exchange medium, respectively.

For such Cu-based core of radiator, brass tubes and Cu or Cu alloy corrugated fins are used generally, and the fins are fitted up between tubes by a type soldering called core burning. For the fin, Cu or Cu alloy strip having a thickness of 0.025 to 0.060 mm is used, and, in order to improve the strength and the heat resistance, small amounts of Sn, Ag, Cd, P, Zr, Mg, etc. are added within a range not lowering the heat transferability. Moreover, on the radiator having a Cu core, black paint is coated for the purpose of preventing the dazzlement, but this treatment is confined only to the outer surface of radiator and the thickness is also confined to less than 10 μm, since the thicker film is harmful to the radiation of fin section.

In recent years, a large quantity of chlorides such as NaCl etc. has been scattered on the road for the purpose of melting snow etc., and the corrosion of the body of car by these chlorides is taken seriously. The fret of the fin is intense also with the heat exchangers for car such as radiator, air conditioner, etc., and the lowering in the radiation ability has become a subject of discussion. For this reason, the use of corrosion-resistant alloys such as Cu-Ni-based one etc. was investigated for the fin, but, because of the low heat transferability, the thickening became necessary to achieve the predetermined performance, which led to the high price and the increase in weight. Moreover, with conventional materials, the thickening having made allowance for the margin to corrosion and the painting for the prevention from corrosion brought also about similar results making it impossible to fit for practical use.

On the other hand, the lightening in weight of car is desired from a view point of energy conservation. The lightening in weight is desired also with the heat exchanger being parts of the car. However, it has been difficult technically to satisfy both the measures against salt damage aforementioned and the requirement of lightening simultaneously.

SUMMARY OF THE INVENTION

As a result of various investigations in view of this situation, a fin in a heat exchanger which has an excellent corrosion resistance standing up to the severe environment over a long period of time and a sufficient heat transferability and which is difficult to be corroded and worn out even if thinned for the lightening in weight and which is capable radiation ability for a long time, and a method of making it have been developed by the invention.

Namely, the fin of the invention is characterized in that a Cu-Zn diffused alloy layer with a Zn content of not less than 1 wt % is formed on the surface of a Cu-based substrate.

Moreover, the method of making the fin of the invention is characterized in that Zn is allowed to diffuse thermally after covered the surface of Cu-based substrate with Zn or Zn alloy or the alloy layer with a Zn content of not less than 1 wt % is formed on the surface by carrying out rolling and tempering after the thermal diffusion.

DETAILED DESCRIPTION OF THE INVENTION

Figure 1:
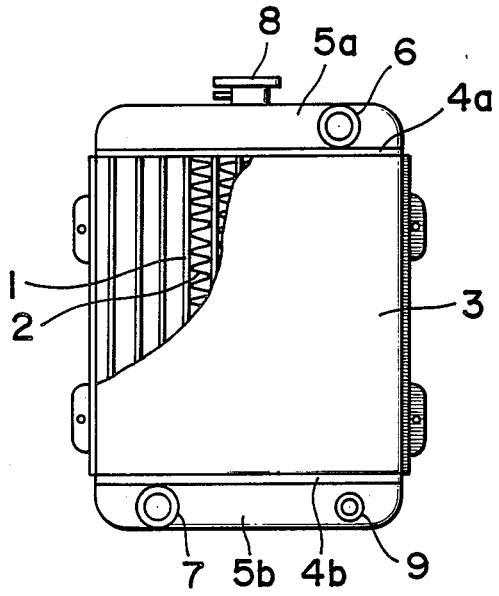
FIG. 1 is a front view showing an example of radiator for the car.

For the Cu-based substrates, thin copper alloy plates such as Cu-Zn, Cu-Cr, Cu-Ag, Cu-Sn, Cu-Cd, Cu-Pb-Sn, Cu-In, Cu-Te, etc., which are highly electroconductive (Highly heat-transferable) and can be improved in the strength through the alloy effect, for example, high electroconductive alloy plates having an electroconductivity of not less than 85% IACS, preferably of 90 to 98% IACS are used besides pure Cu. On these substrates, Zn or Zn alloys such as pure Zn or Zn-Cu, Zn-Ag, Zn-Sn, Zn-Cd, Zn-Ni, Zn-Fe, Zn-Pb, Zn-Bi-Pb, Zn-Ni-Co, Zn-As, Zn-Sb. etc. are covered by means of electroplating, PVD, etc., which are heated above the diffusion temperature of Zn to allow Zn to diffuse from the surface of the substrates.

The method by which Zn or Zn alloy is covered at high temperature and sufficient diffusion is allowed to proceed simultaneously may be useful from a viewpoint of the shortening of processes. The temperature is preferable to be higher than 350° C. practically and the hot-dip and the metallization method are put into effect advantageously.

After the manufacturing processes described above, the rolling processing and the tempering such as annealing etc. are carried out, if necessary, to finish to a desired size and the alloy layer with a Zn content of not less than 1 wt %, preferably of not less than 10 wt% is formed on the surface, the thickness of the alloy layer being preferable to be not less than 1 μm and not more than one fourth of the thickness of fin plate.

From the fact that the fin material is used usually as the strip material with a thickness of 0.05 to 0.025 mm, it may be desirable to form the diffused layer aforementioned on the surface of the substrate with a thickness of about 1.0 mm and, thereafter, to carry out the rolling processing and the tempering such as annealing etc. to finish to a desired size.

With the fin of the invention, such treatment as the Cu-Zn diffused layer aforementioned is formed on a portion of the surface, in particular, within a range not more distant than 10 mm from the edge of the fin exposed to the outer circumference of the heat exchanger is as effective as the treatment on the whole surface. Besides the partial covering-diffusion treatment on the fin material, the covering-diffusion treatment can also be made after the construction of the heat exchanger.

The fin material of the invention has made both the measures against salt damage aforementioned and the lightening in weight possible by improving the corrosion resistance under the conditions of salt damage aforementioned through the formation of the alloy layer with a Zn content of 1 wt % on the surface of Cu-based substrate and by making highly electroconductive (highly heat-transferable) through the core portion comprising the alloy with a Zn content of not more than 1 wt %.

Namely, it has been known experimentally that the addition of Zn to Cu is effective for the prevention from the corrosion by salt damage. Pure Zn is a metal apt to be corroded under the conditions of salt damage, whereas, excellent corrosion resistance is not exhibited until the alloying with Cu. Moreover, the Zn diffused layer has a distribution of the concentration of Zn decreasing continuously from the surface to the interface with the core material. For this reason, the surface becomes anodic against the inner portion and the inner portion becomes cathodic over the whole period of corrosion resulting in the prevention from corrosion. The mode of corrosion is the general corrosion being suppressed and averaged over the whole surface, so that the rapid deterioration of the strength of fin due to the corrosion in the shape of corrosion pits having been observed conventionally with the fin made from Cu only or Cu alloy can be suppressed to a great extent.

When adding Zn to Cu, the electroconductivity decreases to, for example, 80 to 85% IACS by the addition of 1 wt % of Zn, about 70% IACS by the addition of 3 wt %, about 44% IACS by the addition of 10 wt % and about 25% IACS by the addition of 30 wt %. Therefore, if the desired corrosion resistance is aimed simply by the addition of Zn, the electroconductivity (heat transferability) is lowered resulting in the unsuitableness for the fin. So, in accordance with the invention, the alloy layer with a Zn content of not less than 1 wt %, preferably of not less than 10 wt % is formed in a thickness of not less than 1 μm on the surface of Cu-based substrate to improve the corrosion resistance under the conditions of salt damage aforementioned and the alloy layer with high amount of Zn is confined to the surface to prevent the lowering in the electroconductivity.

Usually, by making the thickness of the surface layer not more than one fourth of that of fin plate, the electroconductivity more than 70% IACS can be displayed in most cases.

In the Zn-Cu diffused layer of the invention, Zn or Zn alloy surface layer unreacted with the surface layer may be left behind. Although this is corroded relatively fast at the beginning of corrosion, the Cu-Zn diffused layer underneath it acts corrosion-preventively at the next step.

Figure 2:
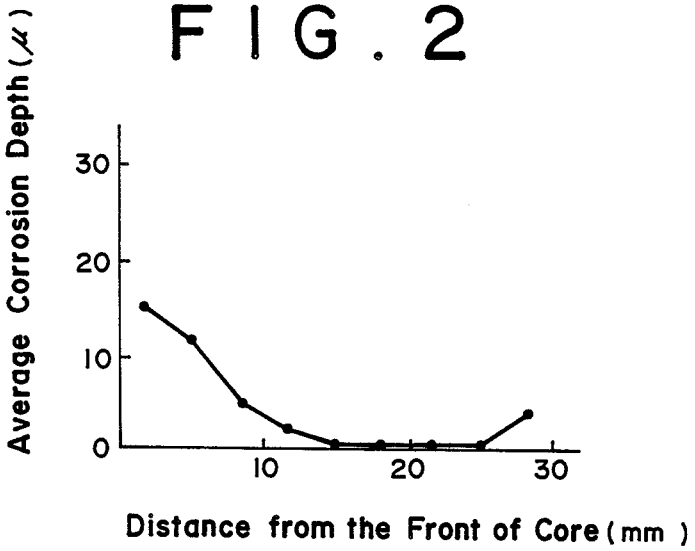
FIG. 2 is an illustration diagram showing the distribution of average corrosion amount of radiator in the seashore area.

As a method of making the heat transferability (or electroconductivity) larger with the fin of the invention, Zn covering is made only on the fin portion corresponding to the outer circumference of the heat exchanger where the corrosion concentrates intensely. The salt adheres in a large amount to the outer circumferential portion, but the adherence is confined within a distance not more than 10 mm from the edge of the fin according to many experiences in the heat exchangers for car. FIG. 2 is an example thereof, which shows a distribution of the corrosion of radiator (fin: Cu-0.15 Sn alloy, 0.046 mm thickness×30 mm width) having runned a mileage of 1,000 km in the seashore area. As evident from the diagram, the distribution is almost biased toward 10 mm from the front and 7 mm from the rear.

Moreover, with the fin material of the invention, Zn diffused layer can be formed on the surface through the covering by means of industrially simple electroplating, hot dip, PVD, mechanical cladding method, etc. and the thermal diffusion. In particular, by means of electroplating, the covering of Zn or Zn alloy accurate in the thickness and uniform as possible. Moreover, in order to form the alloy layer with a predetermined thickness, the heat treatment may be done at a temperature of 250° to 700° C. or higher than this. Furthermore, by passing the Cu-based substrate through the vapor of Zn at higher than 500° C., covering with Zn and diffusion thereof can be made all at once.

EXAMPLE 1

Using heat-resistant Cu strips (electroconductivity 95.9% IACS) having a thickness of 0.07 mm and containing 0.06 wt % of Cd, Zn was electroplated on said strips in a bath described below to thicknesses shown in Table 1 and, after the diffusion treatment under the conditions shown in Table 1, these were submitted to the rolling processing to convert to the fin materials with a thickness of 0.038 mm.

With these fins, the electroconductivity was measured, while the cross section was analyzed by the use of X-ray microanalyzer to determine Zn contents on the surface and at the depths of 1 and 5 μm under the surface. Moreover, corrosion test described below was carried out to determine the average amount of corrosion by weight method and further the tensile test was carried out on the fin before and after the corrosion to determine the reduction rate in the strength. These results are shown in Table 1 in comparison with those of heat-resistant Cu strip plated only with Zn and heat-resistant Cu strip without the treatment.

| Plating bath | |
|---|---|
| NaCN | 50 g/l |
| $Zn(CH)_2$ | 70 g/l |
| NaOH | 100 g/l |
| Bath temperature | 30° C. |
| Current density | 3 A/dm$^2$ |

CORROSION TEST

After the saline was sprayed for 1 hour according to JIS Z2371, the strip was kept for 23 hours in conditioning oven regulated to 60° C. and 95% RH. This procedure was repeated 30 times.

As evident from Table 1, in the cases of Zn-plated fin No. 4 and fin without treatment No. 5, the amount of corrosion reached to 8 to 9 μm (one side) averagely and the reduction rate in the strength was about 85%, the state of the strips having become almost crumbly. Whereas, it can be seen that, in the cases of fins of the invention No. 1 and 2 formed the alloy layer with a Zn content of not less than 1 wt % on the surface, the deterioration by corrosion remained only slight. In particular, the reason why the amount of corrosion and the reduction rate in the strength are small is due to the fact that the pit corrosion acting significantly on the deterioration of the strength is stopped through the diffusion of Zn on the surface layer. On the other hand, in the case of fin No. 3, Zn content in the alloy layer at a depth of 5 μm from the surface layer being not more than 1 wt %, the amount of corrosion and the reduction rate in the strength are inferior to those in the cases of No. 1 and 2 described above, suggesting that the improvement is insufficient under the severe conditions.

TABLE 1

| Fin No. | Thickness of Zn plating (μm) | Diffusion treatment Temp. (°C.) × Time (Hr) | Electro-conductivity (% IACS) | Zn concentration (wt %) Surface | 1 μm Depth | 5 μm Depth | Amount of corrosion (μm) | Reduction in strength (%) |
|---|---|---|---|---|---|---|---|---|
| Fin of the invention 1 | 0.3 | 450 × 0.5 | 88 | 19 | 10 | 1.4 | 3.7 | 24 |
| Fin of the invention 2 | 0.7 | 520 × 0.25 | 83 | 17 | 12 | 2.6 | 2.0 | 18 |
| Fin of the invention 3 | 0.13 | 350 × 0.25 | 91 | 7.5 | 4.5 | 0.8 | 5.1 | 36 |
| Fin plated with Zn 4 | 0.7 | — | 95 | 100 | — | — | 7.3 | 80 |
| Fin without treatment 5 | — | — | 95.9 | 0 | — | — | 8.9 | 87 |

TABLE 2

| Fin No. | Thickness of plating (μm) | Diffusion treatment Temp. °C. × Time Hr | Electro-conductivity (% IACS) | Zn concentration (wt %) Surface | 1 μm Depth | 1 μm Depth | Amount of corrosion (μm) | Reduction in strength (%) |
|---|---|---|---|---|---|---|---|---|
| Fin of the invention 6 | 0.3 (Zn-5 wt % Ni) | 450 × 0.5 | 89 | 21 | 14 | 1.2 | 3.3 | 21 |
| Fin of the invention 7 | 0.3 (Zn-10 wt % Cd) | 450 × 0.5 | 88 | 19 | 11 | 1.5 | 3.8 | 26 |
| Fin of the invention 8 | 0.08 (Zn-5 wt % Ni) | 450 × 0.5 | 93 | 4.9 | 2.1 | 0.1 | 6.9 | 62 |
| Fin plated 9 | 0.3 (Zn-5 wt % Ni) | — | 95.5 | 95 | — | — | 8.7 | 82 |
| Fin plated 10 | 0.3 (Zn-10 wt % Cd) | — | 95.4 | 90 | — | — | 9.0 | 86 |

Plating bath of Zn-5 wt % Ni alloy

| | |
|---|---|
| $ZnSO_4$ | 75 g/l |
| $NiSO_4$ | 60 g/l |
| $CH_3COONa$ | 20 g/l |
| $H_3BO_3$ | 15 g/l |

| | |
|---|---|
| pH | 3 |
| Bath temperature | 45° C. |
| Current density | 7.5 A/dm$^2$ |

Plating bath of Zn-10 wt % Cd alloy

| | |
|---|---|
| $Zn(CN)_2$ | g/l |
| CdO | 4 g/l |
| NaCN | 45 g/l |
| NaOH | 80 g/l |
| Bath temperature | 35° C. |
| Current density | 2 A/dm$^2$ |

EXAMPLE 2

Employing plating baths described below in place of Zn plating in Example 1, Zn-5 wt % Ni alloy and Zn-10 wt % Cd alloy were electroplated to the thicknesses shown in Table 2 and, after the diffusion treatment under the conditions shown in Table 2, the strips were submitted to the rolling processing to convert to the fin materials with a thickness of 0.038 mm. Using these fins, similar tests to Example 1 were carried out and the results were compared with those obtained using the fin materials plated simply with Zn-5 wt % Ni alloy and Zn-10 wt % Cd alloy.

As evident from Table 2, it can be seen that, in the cases of fins of the invention No. 6 and 7 formed the alloy layer with a Zn content of not less than 1 wt % on the surface by carrying out the diffusion treatment after plating with Zn-5 wt % Ni alloy and Zn-10 wt % Cd alloy, the deterioration by corrosion remained only slight. On the contrary, in the case of fin No. 8, Zn content at 5 μm portion being not more than 1 wt % even though that on the surface being not less than 1 wt %, the improvement in the corrosion resistance is inferior to that in the cases of No. 6 and 7, showing the insufficiency under the severe conditions in use.

EXAMPLE 3

Using a heat-resistant Cu strip (electroconductivity 98% IACS) having a thickness of 0.06 mm and containing 0.09 wt % of Ag, the diffusion treatment of Zn combined with the intermediate annealing was carried out by exposing said strip for 15 seconds onto a Zn bath fused at 590° C. in an atmosphere of $H_2$. This was submitted to the rolling to a thickness of 0.035 mm to convert to the fin material. Using this, tests were made similarly to Example 1. The results are shown in Table 3 compared with those of the fin omitted the treatment as above.

TABLE 3

| Fin | Electro-conductivity (% IACS) | ZN concentration (wt %) Surface | 1 μm Depth | 5 μm Depth | Amount of corrosion (μm) | Reduction rate in strength (%) |
|---|---|---|---|---|---|---|
| Fin of the invention | 89.0 | 18 | 13 | 1.2 | 3.6 | 21 |
| Fin without treatment | 97.0 | 0 | — | — | 8.8 | 90 |

It is obvious from Table 3 that the corrosion resistance of the fin of the invention is improved remarkably compared with that of the fin without treatment.

EXAMPLE 4

In the example above, after hot-dipping for 4 seconds into the Zn bath, the strip was wiped and cooled. The rolling was carried out similarly to finish. Results of the similar tests are shown in Table 4. As evident from the table, the corrosion resistance is improved drastically.

TABLE 4

| Fin | Electro-conductivity (%) IACS | Zn concentration (wt %) Surface | 1 μm Depth | 5 μm Depth | Amount of corrosion (μm) | Reduction rate in strength (%) |
|---|---|---|---|---|---|---|
| Fin of the invention | 79.1 | 34 | 18 | 0.9 | 2.4 | 18 |
| Fin without treatment | 97.0 | 0 | — | — | 8.8 | 90 |

EXAMPLE 5

A radiator fitted with corrugated fins comprising of Cu-0.15 Sn-0.01P alloy and having a thickness of 0.040 mm and a width of 32 mm, the construction thereof being shown in FIG. 1, was assembled as usual. Besides, this radiator was provided with two rows of tubes to the width of the fin.

Under the plating conditions in Example 1 aforementioned, one side each of the radiator was dipped partially while Zn was plated to a thickness of 0.9 μm at distances of 3 and 9 mm from the adge of the fin. These were heated for 3 hours at 280° C.

Using the articles of the invention thus obtained and the conventional article without the treatment, a cycle of the procedure, wherein the exposure to the saline (JIS Z2371) was conducted for 10 minutes and further the dampening exposure under 60° C.×90% RH was made for 23 hours, was repeated 60 times. Besides, in order to simulate the running of practical car, the test aforementioned was conducted in wind channel and the saline was sprayed onto the radiator at a speed corresponding to the running of 60 km/hr. From the results shown in Table 5, the deterioration of the articles of the invention can be seen to be improved significantly.

TABLE 5

| Fin | Electro-conductivity (% IACS) | Zn concentration (wt %) Surface | 1 μm Depth | 5 μm Depth | Reduction rate in strength (%) |
|---|---|---|---|---|---|
| Article of the | 80 | 39 | 21 | 0.8 | 45 |

TABLE 5-continued

| Fin | Electro-conductivity (% IACS) | Zn concentration (wt %) Surface | 1 μm Depth | 5 μm Depth | Reduction rate in strength (%) |
|---|---|---|---|---|---|
| invention 3 mm | | | | | |
| Article of the invention 9 mm | 82 | 36 | 16 | 0.9 | 36 |
| Article without treatment | 88 | — | — | — | 75 |

As described, the fin of the invention has excellent corrosion resistance and heat transferability, never loses the function as a fin for a long period of time even under the severe environment and makes the thinning and lightening possible. Particularly, when used for the heat exchanger for car, it renders not only the lightening in weight but also the improvement in the life possible. Therefore, it exerts remarkable effects industrially.

What is claimed is:

1. A fin for a heat exchanger comprising a Cu-Zn diffused layer having a Zn content of not less than 1 wt % formed on at least a portion of the surface of a Cu-based fin substrate, wherein the concentration of Zn decreases continuously from the outside surface of the Cu-Zn diffused layer to the interface between that layer and the Cu-based fin substrate.

2. The fin of a heat exchanger according to claim 1, wherein the Cu-Zn diffused alloy layer with a Zn content of not less than 1 wt % has a thickness of not less than 1 μm and not more than one fourth of the thickness of fin plate in the diffused layer.

3. The fin of a heat exchanger according to claim 1, wherein the Zn diffused layer is formed on the surface not more distant than 10 mm from the edge of the fin exposed to the outer circumference of the heat exchanger.

4. The fin of a heat exchanger according to claim 1, wherein the fin material is in the shape of a heat exchanger of a car.

5. A heat-exchanger for a car comprising, a plurality of brass tubes running substantially parallel to one another and having two ends, heat-exchanging fluid disposed within the brass tubes, a plurality of corrugated fins being disposed between the brass tubes and being bonded thermally to the brass tubes to promote heat-exchange of the heat-exchange fluid, an upper tank disposed at one end of the brass tubes and in liquid communication with the brass tubes, a lower tank disposed at the other end of the brass tubes and also in liquid communication with the brass tubes, wherein the fins comprise fin substrate made from copper or a copper alloy, and diffuse layers formed on at least one surface of the fin substrate, the diffuse layers containing both the copper or copper alloy of the fin substrate and zinc or zinc alloy, said diffused layer having a Zn content of not less than 1 wt %, wherein the concentration of Zn decreases continuously from the outside surface of the Cu-Zn diffused layer to the interface between that layer and the Cu-based fin substrate.

6. The heat-exchanger for a car of claim 5, wherein the diffusion layers have a uniform thickness.

7. The heat-exchanger for a car of claim 5, wherein the diffusion layers are formed from zinc or zinc alloy which has been applied to the fin substrate by electroplating.

8. The heat-exchanger for a car of claim 5, wherein the diffusion layers are formed from zinc or zinc alloy which has been applied to the fin substrate by hot dipping.

9. The heat-exchanger for a car of claim 5, wherein the diffusion layers are formed from zinc or zinc alloy which has been applied to the fin substrate by an evaporation process.

10. The heat-exchanger for a car of claim 5, wherein the diffusion layers have been formed by the application of heat to the surface of the base fins.

11. The heat-exchanger for a car of claim 5, wherein the diffusion layers have been formed by allowing all portions of the zinc or zinc alloy to diffuse into the fin substrate.

12. The heat-exchanger for a car of claim 5, further comprising a first seat plate covering an end portion of the upper tank, a second seat plate connected to the brass tubes, an exhaust port being positioned within the lower tank, and an outflow port being positioned within the lower tank and being connected to the second seat plate.

* * * * *

UNITED STATES PATENT AND TRADEMARK OFFICE

CERTIFICATE OF CORRECTION

PATENT NO. : 4,892,141

DATED : January 9, 1990

INVENTOR(S) : SHIGA et al

It is certified that error appears in the above-identified patent and that said Letters Patent is hereby corrected as shown below:

On the cover page:

Item [63], delete "Dec. 27, 1988, abandoned" and insert therefor --June 12, 1986, now abandoned--;

Signed and Sealed this

Tenth Day of March, 1992

*Attest:*

*Attesting Officer*

HARRY F. MANBECK, JR.

*Commissioner of Patents and Trademarks*